United States Patent [19]

White

[11] Patent Number: 4,506,392

[45] Date of Patent: Mar. 26, 1985

[54] ATHLETIC UNDERGARMENT

[76] Inventor: Alice C. White, 105 Pulis Ave., Franklin Lakes, N.J. 07417

[21] Appl. No.: 452,762

[22] Filed: Dec. 23, 1982

Related U.S. Application Data

[63] Continuation-in-part of Ser. No. 175,729, Aug. 6, 1980, Pat. No. 4,368,546.

[51] Int. Cl.[3] ..... A41B 11/00

[52] U.S. Cl. ..... 2/239; 2/409

[58] Field of Search ..... 2/409, 239, 241, 80, 2/83, 79; 66/177, 178 A, 183; 128/165

[56] References Cited

U.S. PATENT DOCUMENTS

| | | | |
|---|---|---|---|
| 256,532 | 4/1882 | Appelton | 2/409 X |
| 319,131 | 6/1885 | Ryer | 2/239 |
| 364,650 | 6/1887 | Holmes | 2/409 X |
| 422,641 | 3/1890 | Scott | 66/177 |
| 726,300 | 4/1903 | Hundel | 2/239 X |
| 1,162,820 | 12/1915 | Taylor | 2/239 |
| 1,227,217 | 5/1917 | Taylor | 2/239 X |
| 1,534,763 | 4/1925 | Bosworth | 2/241 X |
| 2,617,992 | 11/1952 | Bean | 2/241 |
| 3,212,103 | 10/1965 | Goodman | 66/177 X |

*Primary Examiner*—H. Hampton Hunter

*Attorney, Agent, or Firm*—Sixbey, Friedman & Leedom

[57] ABSTRACT

The present invention comprises an athletic undergarment having trunk and leg portions woven from a sheer, resiliently elastic material and foot portions knit from heavy compressible yarn. The leg portions are permanently secured to the interior of the foot portions by stitching in a manner which maximizes the area of contact between the yarn and the wearer's feet. The resilient elasticity of the sheer trunk and leg portions furnish muscle support and circulatory stimulation for the wearer's legs, while the knit foot portions prevent relative slippage and excessive perspiration build-up between the foot portions and the wearer's shoes.

10 Claims, 4 Drawing Figures

ATHLETIC UNDERGARMENT

CROSS-REFERENCE TO RELATED APPLICATIONS

This application is a continuation-in-part of pending U.S. application Ser. No. 175,729, filed Aug. 6, 1980, now U.S. Pat. No. 4,368,546, dated Jan. 18, 1983.

TECHNICAL FIELD

This invention relates to the field of wearing apparel and more particularly to an article of wearing apparel which combines the advantages of both support hose and athletic socks in a one piece undergarment suited for use in conjunction with athletic activity.

BACKGROUND ART

Tennis players or those participating in other strenuous athletic activites are often faced with a dilemma when selecting wearing apparel appropriate to the engaged-in activity. On the one hand, the rigors of sport, and in particular the stress on the participant's feet, demand that some sort of protective foot coverings or socks be worn together with athletic shoes in order to properly cushion the feet and to aid in removing the moisture of perspiration therefrom. On the other hand, aesthetic considerations or the need for circulatory stimulation and muscle support frequently dictate the use of some type of elastic panty hose or support hose as an undergarment. Heretofore, the only means for obtaining the advantages of both support hose and athletic foot gear has been for the participant to first don a support hose garment and then pull on athletic socks over the conventional foot portions of the support hose. This solution, however, has proven to be highly unsatisfactory inasmuch as the synthetic fiber material from which most support hose are made tends to slip relative to the heavier yarn or wool threads of the athletic socks. Consequently, a person wearing athletic socks over the foot portions of conventional support hose risks severe blistering of the feet and serious injury from falls while executing the rapid movements normally associated with most athletic activity. Moreover, the synthetic fibers of support hose have notoriously poor moisture transmitting characteristics, and perspiration tends to collect between the fibers and the feet of a person wearing socks over the foot portions of the hose. It can thus be seen that any garment seeking to combine the leg support, circulatory stimulation and aesthetic appeal of elastic support hose with the protection and comfort of athletic socks must avoid the above-mentioned disadvantages if it is to serve as a truly practical, desirable and beneficial alternative to the wearing of conventional garb.

The prior art discloses numerous examples of stockings or panty hose-type clothing wherein the foot sections of the stockings are modified to provide special wearing qualities or features. For instance, it is well known to employ reinforcing material in the construction of the heel or lower foot sections of hoisery, as evidenced by U.S. Pat. No. 1,227,217, issued to Taylor on May 22, 1917; U.S. Pat. No. 1,534,763, issued to Bosworth on Oct. 14, 1922; U.S. Pat. No. 2,617,992, issued to Bean on Nov. 18, 1952; and U.S. Pat. No. 3,212,103, issued to Goodman on Oct. 19, 1965. The teachings of Taylor ('217) are representative of such reinforcing construction. In Taylor ('217), under foot, toe and heel sections comprised of yarn are joined along a nonthickened seam to upper foot and leg sections comprised of silk fabric to produce a finished stocking resistant both to wear occasioned by friction between the bottom of the wearer's feet and the wearer's shoes and to unravelling of the upper foot sections occasioned by broken threads. Although furnishing an article suited to the purposes for which it was intended, Taylor ('217) nevertheless fails to satisfy the additional constraints imposed upon apparel designed to provide protection, support, comfort and aesthetic appeal for the wearer involved in strenuous physical activity. The silk fabric of Taylor's upper foot portion is incapable of passing perspiration to the air, and instead presents a slippery, nonporous and noncompressible surface to the uppers of the wearer's shoes. Nor does Taylor's yarn heel section extend far enough up the leg of the wearer to cushion and protect the critical area surrounding the wearer's ankle. Accordingly, Taylor ('217) does not remedy any of the deficiencies associated with the previous practice of wearing athletic socks over conventional support-type hose.

U.S. Pat. No. 1,162,820, issued to Taylor on Dec. 7, 1915, teaches a stocking-type garment wherein the leg and foot portions are formed of different materials. However the Taylor ('820) stocking forms the foot portion of a high grade, slippery, non-absorbent, non-protective material, such as silk, and the leg portion of a non-muscle supporting, non-circulatory stimulating material, such as cotton. Thus, Taylor ('820) teaches a stocking type garment which is, in construction and purpose, directly opposite to the sort of garment needed by participants in athletic activities in that its foot portion has a tendency to slip and has notoriously poor moisture transmitting characteristics and its leg portion formed of cotton provides neither muscular nor circulatory stimulation.

Other prior art disclosures contain additional teachings relevant to the arrangement and manufacture of specialized foot sections for stockings. For example, U.S. Pat. No. 319,131, issued to Ryer on June 2, 1885, illustrates a foot section releasably secured to the leg section of a stocking such that the foot section may be removed and replaced by a new foot section when soiled or worn beyond use. Unfortunately, Ryer does not assist an athletic participant in solving the problem of how to combine the muscle supporting and circulation stimulating features of elastic fibers with the protective quality and transpirational cooling capacity of heavy yarn. The releasable structure of Ryer's foot section is utterly impractical from the point of view of apparel designed to be worn during an athletic game such as tennis. The fastening bands and buttons utilized in Ryer would be subject to large tensile forces as the wearer's foot moves from position to position and would soon be torn away from the leg section of the stocking. Similarly, the unjoined areas adjacent the ends of the foot and leg sections in Ryer would pull away from one another in response to vigorous motion, leading to a reduction in the supporting capacity of the leg section and a decidedly unaesthetic appearance for the stocking as a whole.

Uniform stitching between the leg, calf, knee, thigh and waist portions of a pair of drawers or tights is disclosed in U.S. Pat. No. 256,532, issued to Appleton on Apr. 18, 1882. The limitations of Ryer, however, are not overcome by the Appleton reference, in view of the fact that Appleton merely rearranges his knitting pattern from section to section and fails to teach either the functional necessity or the structural means for varying the characteristics and composition of the fibers employed in each section. As a net result, the prior art fails to adequately address the need for a durable, inexpensive and conveniently manufactured combination athletic sock/support hose undergarment which may be safely and comfortably worn by individuals engaged in athletic activity.

DISCLOSURE OF THE INVENTION

It is therefore an object of the present invention to provide an undergarment suitable for use during athletic activity.

It is an additional object of the present invention to provide an athletic undergarment which suplies the muscle support, circulatory stimulation and aesthetic appeal of elastic support hose together with the protection and comfort of an athletic sock.

It is yet an additional object of the present invention to provide an athletic undergarment wherein leg portions comprised of elastic material furnish muscle support and circulatory stimulation for the wearer's legs in an aesthetically pleasing manner while foot portions comprised of heavy yarn furnish protection and transpirational cooling for the wearer's feet without the risk of relative slippage between the foot portions, the leg portions and the wearer's shoes.

It is a further object of the present invention to provide an athletic undergarment wherein the muscle supporting and circulation stimulating leg portions of the undergarment are elastically secured to the slippage preventing and perspiration removing foot portions of the undergarment in a manner such that wear on the foot portions due to repeated stretching during periods of strenuous athletic activity is significantly reduced.

These and other objects of the present invention are achieved in an athletic undergarment which combines the functional advantages and aesthetic appeal of support hosiery with the protection and comfort of athletic socks. The trunk and leg portions of the athletic undergarment are formed from a sheer, resiliently elastic material of the type employed in manufacturing support hose. Foot portions of the undergarment, including an ankle section, are comprised of a heavy, compressible yarn knit in the style of an athletic sock. Stitching is used to permanently secure the leg portions, preferably to the interior of the foot portions, in a manner such that the visibility of the stitching is minimized while the area of contact between the heavy, compressible yarn and the wearer's feet is maximized. In one form of the invention the stitching is additionally positioned to exert tensile force on the upper end sections of the foot portions, thereby reducing the tendency of the upper end sections to unravel and slip from the wearer's legs following periods of prolonged usage. The resilient elasticity of the sheer trunk and leg portions furnish both muscle support and circulatory stimulation for the wearer's legs and also impart an aesthetically pleasing appearance normally associated with conventional support hose. On the other hand, the knit foot portions permit the wearer to don athletic style shoes and engage in strenuous activity without the risk of relative slippage between the foot portions, leg portions and the athletic shoes and without the discomfort of excessive perspiration build-up inside the foot portions.

BRIEF DESCRIPTION OF THE DRAWINGS

The various features, objects and advantages of the present invention will become more apparent from the following Brief Description of the Drawings.

BEST MODE FOR CARRYING OUT THE INVENTION

Figure 1:
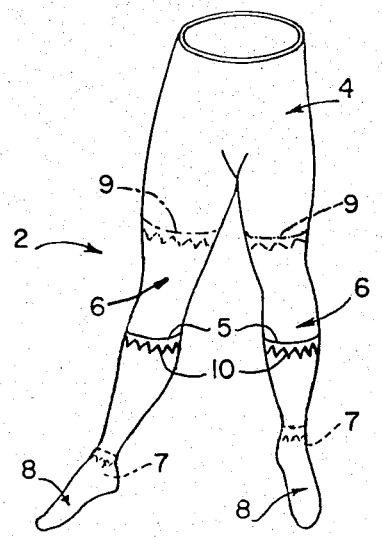
FIG. 1 is a perspective view of an athletic undergarment constructed in accordance with the present invention.

The athletic undergarment of the present invention will now be described in detail. Referring first to FIG. 1, it can be seen that the athletic undergarment, indicated generally at 2, includes a trunk portion 4 for enclosing the hips and crotch of the wearer and two leg portions 6 which extend to a point above the wearer's feet. Trunk portion 4 and leg portion 6 are integrally constructed from a mesh fabric made of highly resilient elastic threads woven to provide a support hose-type structure. When designed for use by women, trunk portion 4 of athletic undergarment 2 may exhibit a smooth exterior surface as shown in FIG. 1, but when designed for use by men the trunk portion may contain a frontal fly arrangement (not shown).

Athletic undergarment 2 also includes two foot portions 8 which completely encompass the wearer's feet. In contrast to the trunk 4 and leg portions 6, foot portions 8 are constructed from heavy, compressible yarn knit in the form of athletic socks to provide a durable, protective covering material. Foot portions 8 illustrated in FIG. 1 are intermediate length style foot portions which terminate in the vicinity of and just below the wearer's knees i.e., at a point on the wearer's calves above the ankles and below the knees (indicated at 5), and leg portions 6 extend to a corresponding point proximate and just below the wearer's knees. Alternately, athletic undergarment 2 may employ short style foot portions which terminate in the vicinity of the wearer's ankles (shown in phantom at 7) or long style foot portions (shown in phantom at 9) which terminate at a point on the wearer's thighs above the knees, whereupon leg portions 6 need only extend to the corresponding point 7 or 9 on the wearer's legs. The foot portion length style which is employed is dependent primarily on the type of footgear used in the athletic activity. Thus, for example, tennis players would likely prefer the short style foot portions for use with tennis style shoes while skaters and/or skiers would likely prefer the intermediate length style foot portions for use with calf length ski boots or skates. Whatever length style is employed, the two foot portions 8 are permanently secured to the lower ends of leg portions 6 via stitching 10 in precisely the same manner. Stitching 10 may consist of any suitably strong synthetic or natural fiber thread sewn in zig-zag fashion, and the positioning of the stitching 10 may be chosen as described in greater detail hereinbelow to enhance the advantageous characteristics of both the leg portions and the foot portions.

Figure 2:
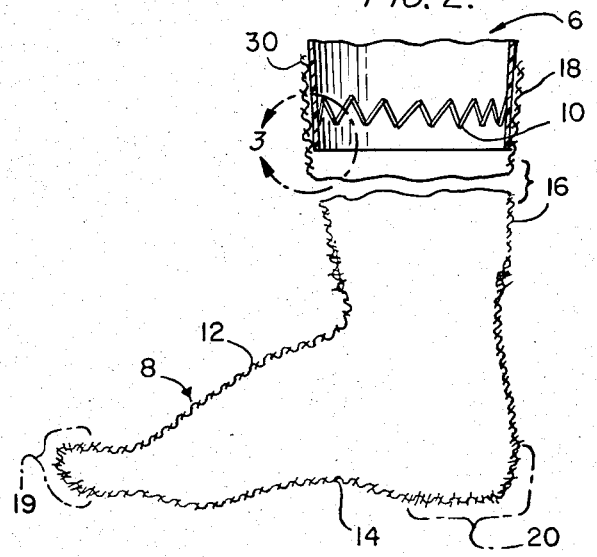
FIG. 2 is a cross-sectional view of the foot portion of the athletic undergarment illustrated in FIG. 1.

FIG. 2 is a cross-sectional view of an intermediate length foot portion 8 as secured via stitching 10 to an associated leg portion 6 in accordance with the present invention. Foot portion 8 completely surrounds the wearer's foot, and includes an upper section 12, a sole section 14, an ankle section 16 and a calf section 18. For obvious reasons, if foot portions 8 were short style foot portions terminating just above the wearer's ankles there would be no appreciable calf section. Likewise, if foot portions 8 were long style foot portions, the upper end thereof would include knee and/or thigh sections (not shown). The durability of athletic undergarment 2 can be increased if desired by knitting reinforced toe and heel sections 19, 20 into foot portion 8. Leg portion 6 extends into the interior of calf section 18, but terminates a short distance thereafter at a point well above the wearer's foot in order to minimize the area of contact between the mesh fabric of leg portion 6 and the heavy yarn or wool threads of foot portion 8. The area of contact between the heavy yarn or wool threads of foot portion 8 and the skin on the wearer's foot is in turn maximized. Such a relationship between the various components of athletic undergarment 2 reduces the potential for relative slippage between the leg portion 6 and the foot portion 8, while the presence of both upper section 12 and sole section 14 in foot portion 8 significantly increases the amount of gripping surface available on the foot portion for frictionally engaging the interior of any shoe placed over the wearer's foot. Consequently, the likelihood that the wearer will fall during periods of heavy activity and sustain serious injury is reduced. The maximized contact area between foot portion 8 and the skin on the wearer's foot, and in particular the contact between upper section 12 and the wearer's foot, also assists in preventing the formation of blisters and aids in the transpirational removal of perspiration.

Figure 3:
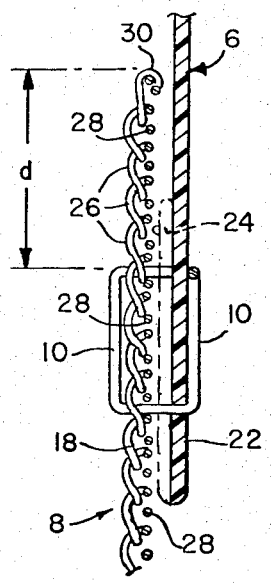
FIG. 3 is an enlarged cross-sectional view of the juncture between the foot and leg portions of the athletic undergarment illustrated in FIGS. 1 and 2.

Turning now to FIG. 3, a more detailed view of the juncture between leg portion 6 and the calf section 18 of the foot portion 8 is illustrated. Stitching 10 is sewn back and forth between the layer 22 of mesh fabric in leg portion 6 and the calf section 18 of foot portion 8 to permanently fasten the foot portion to the leg portion. With some fabrics, in order to provide for a more durable stitch, the end weave along the lowermost edge of the mesh fabric comprising leg portion 6 may optionally be folded back to form a double layer 22, 24 (shown in phantom) of mesh fabric in the area of the stitch, in which case stitching 10 secures the double layer 22,24 of mesh fabric to foot portion 8. As previously indicated, foot portion 8 is comprised of heavy yarn or wool knit in the form of an athletic sock-type structure, and calf section 18 accordingly may contain a plurality of threads 26 hooked to form a series of upstanding or vertical ribs about the exterior of the calf section. A plurality of elastic threads 28 may be circumferentially interwoven between threads 26 to prevent calf section 18 from losing its shape and slipping down the wearer's calf toward the ankle. Stitching 10 is sewn at a predetermined distance from the end threads 30 at the top of calf section 18 such that the stitching secures the mesh fabric layer 22 (or layers 22,24) of leg portion 6 to at least some of the elastic threads 28. The tension exerted by the resilient elastic threads of the mesh fabric comprising leg portion 6 thus tends to pull calf section 18 of foot portion 8 upward, reducing wear on the elastic threads 28 and preventing the calf section 18 from sagging or sliding downward toward the wearer's ankle following prolonged periods of usage. The predetermined distance, d, may be on the order of one-half to three inches, depending upon the size of the foot portion 8, but in no event should the distance be less than that required to position the uppermost portions of stitching 10 completely below the end threads 30 of calf section 18. Otherwise, the constant stress exerted by leg portion 6 on calf section 18 would tend to unravel end threads 30, and the resulting acceleration of wear on threads 26 would render the athletic undergarment of the present invention less desirable for use during athletic activities.

Figure 4:
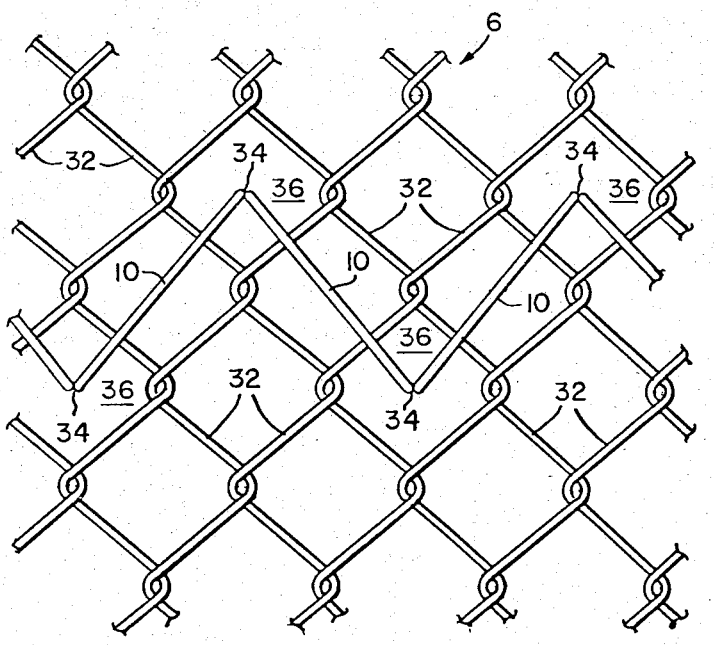
FIG. 4 is an enlarged view of a segment of stitching used to join the foot portion to the leg portion in FIG. 3.

FIG. 4 provides a detailed view of stitching 10 in relation to the mesh fabric of leg portion 6. For purposes of illustration, leg portion 6 is shown as a series of elastic fibers 32 arranged in a fish-net weave, but any suitable weave will suffice. Stitching 10 is sewn in a zig-zag fashion to pass through the threads of calf section 18 (not shown in FIG. 4) at points 34 within nonadjacent loops 36 of the fish-net arrangement. The zig-zag pattern of stitching 10 is necessary in order to prevent the stitching from pulling out of or unravelling from leg portion 6 in response to the normal stresses imposed on the leg portion during athletic activity.

INDUSTRIAL APPLICABILITY

The athletic undergarment of the present invention combines the functional advantages of both support hose and athletic socks without subjecting the wearer to the disadvantages which would otherwise accrue if conventional support hose and athletic socks were independently worn. In particular, the resilient elasticity of the threads comprising the mesh fabric of leg portion 6 exerts a compressive force to both stimulate the circulation in the wearer's legs and support the wearer's muscles. The fine weave of the mesh or net fabric is further characterized by a sheer texture which imports an aesthetically pleasing appearance to the wearer's legs. The heavy, compressible yarn of the foot portion serves as a buffer medium, completely covering the wearer's foot to provide a protective, nonslipping surface for engaging the interior of the wearer's athletic shoe. The athletic undergarment of the present invention thus enables a wider cross-section of the population to engage in athletic activity with confidence. For example, women in the early months of pregnancy can wear the undergarment while jogging or playing tennis. The muscle support provided by the leg portions relieves the tiredness and aching of the leg muscles which so often accompany pregnancy, while the nonslipping characteristics of the foot portions lessen the danger of falling. As a result, pregnant women can be encouraged to participate in safe, healthful physical activity without fear of risking injury to either mother or child. Other persons, such as those suffering from poor circulation in the legs or varicose veins, can likewise benefit from using the undergarment of the present invention to join in athletic activity previously considered too demanding or discomforting.

Only one embodiment of the present invention has been shown and described in the specification. It is understood, however, that various additional changes and modifications in the form and detail of the novel athletic undergarment illustrated above may be made by those skilled in the art without departing from the scope and spirit of the invention. It is therefore the intention of the inventor to be limited only by the following claims.

I claim:

1. An athletic undergarment for providing circulatory stimulation and muscle support to the wearer's legs and for protecting and comforting the wearer's feet while preventing relative slippage between the feet and the wearer's shoes, said athletic undergarment comprising at least one leg portion formed from resiliently elastic material which terminates at a point above the wearer's foot and a foot portion formed from a heavy, compressible knit material which is secured to the leg portion such that the foot portion completely surrounds the wearer's foot to provide gripping surfaces along the top and bottom thereof for resisting slippage inside the wearer's shoe while permitting transpirational removal of perspiration from the wearer's foot, said foot portion including an ankle section and said leg portion being permanently secured to the interior surface of said foot portion by stitching.

2. An athletic undergarment for providing circulatory stimulation and muscle support to the wearer's legs and for protecting and comforting the wearer's feet while preventing relative slippage between the feet and the wearer's shoes, said athletic garment comprising a trunk portion formed from resiliently elastic material, leg portions also formed from resiliently elastic material and integrally joined to said trunk portion, said leg portions terminating at a point above the wearer's feet and foot portions formed from a heavy compressible knit material and respectively secured to the leg portions such that the foot portions completely surround the wearer's feet to provide gripping surfaces along the top and bottom thereof for resisting slippage inside the wearer's shoes while permitting transpirational removal of perspiration from the wearer's feet, said foot portions including ankle sections and said leg portions being permanently secured to the interior surface of said foot portions by stitching.

3. An athletic undergarment as set forth in claims 1 or 2 wherein each said foot portion includes a calf section, said leg portion being secured to said calf section.

4. An athletic undergarment as set forth in claim 3, wherein said calf section includes a plurality of threads hooked one over the other to form a series of vertical ribs about the exterior of said calf section while a plurality of elastic threads are circumferentially interwoven through said vertical ribs.

5. An athletic undergarment as set forth in claim 4, wherein said stitching is positioned at a predetermined distance below the top of said calf section such that said stitching secures said resiliently elastic material in said leg portion to at least some of said elastic threads.

6. An athletic undergarment as set forth in claim 5, wherein said predetermined distance between the top of said calf section and said stitching is such that said stitching does not contact any of the uppermost threads which form the top of said calf section.

7. An athletic undergarment as set forth in claim 6, wherein said predetermined distance is in a range from one-half to three inches.

8. An athletic undergarment as set forth in claims 1 or 2, wherein said resiliently elastic material of said leg portion is woven in a fish-net fashion to provide a mesh fabric which imparts a sheer appearance to said leg portion.

9. An athletic undergarment as set forth in claims 1 or 2, wherein said heavy, compressible knit material forming said foot section is comprised of yarn.

10. An athletic undergarment as set forth in claims 1 or 2, wherein the bottom edge of said leg portion is folded back for a short distance upon the remaining material in said leg portion to provide a double layer of resiliently elastic material in the area of said stitching.

* * * * *